United States Patent [19]

Guerit et al.

[11] 4,068,513

[45] Jan. 17, 1978

[54] METHOD OF DRAWING LIGHT METALS AND ALLOYS AT VERY HIGH SPEEDS

[75] Inventors: Pierre Guerit, Chambery; Gilbert Pollet, La Rivoire, both of France

[73] Assignee: Servimetal, Paris, France

[21] Appl. No.: 757,607

[22] Filed: Jan. 7, 1977

[30] Foreign Application Priority Data

Jan. 28, 1976 France ..... 76 02852

[51] Int. Cl.[2] ..... B21C 9/02

[52] U.S. Cl. ..... 72/42; 106/47 R; 252/25

[58] Field of Search ..... 72/42, 46; 106/47 R; 252/25

[56] References Cited

U.S. PATENT DOCUMENTS 3,481,749 12/1969 Godron ..... 72/42 X

FOREIGN PATENT DOCUMENTS 601,428 7/1960 Canada ..... 106/47 R 685,151 4/1964 Canada ..... 106/47 R

*Primary Examiner*—E. M. Combs

*Attorney, Agent, or Firm*—McDougall, Hersh & Scott

[57] ABSTRACT

The invention concerns the conversion of light alloys.

By lubricating the die with a vitreous substance based on alkaline phosphate and alkaline tetraborate, alloys based on aluminium or magnesium can be hot-drawn at speeds of at least 100 meters per minute and up to 300 meters per minute.

The invention can be applied to drawing aluminium alloys, particularly those of series 2,000, 5,000 and 7,000.

3 Claims, No Drawings

METHOD OF DRAWING LIGHT METALS AND ALLOYS AT VERY HIGH SPEEDS

The invention, which is the result of work done by Monsieur Pierre GUEROT and Monsieur Gilbert POLLET, concerns a very high speed method of hot-drawing light metals and alloys, particularly aluminium, magnesium and alloys based on either metal.

It is known to proceed to the hot-drawing of very tough metals, particularly steel, by lubricating the dies with a glass which has a viscosity of approximately $10^3$ to $10^4$ poises at the drawing temperature which is generally from 1050° to 1150° C. This reduces wear on the dies, reduces the drawing pressure and gives the products drawn an excellent surface.

These procedures are described in patents belonging to Ugine-Sejournet, particularly French Pat. Nos. 966.773, 1.041.251, 1.086.008 and 1.094.534, 1.148.824, to quote only the oldest.

Attempts have already been made to apply these processes to alloys based on aluminium.

French Pat. No. 1.126.196 underlines the difficulties in drawing aluminium with lubrication by glass, and claims the use of graphita, which is considered preferable.

Certificate of addition Nos. 67.841, 67.842 and 67.843 to respective French Pat. Nos. 1.107.913, 1.121.659 and 1.121.660 describe hot-drawing of aluminium-silicon-magnesium alloys (6000 series) and aluminium-zinc-copper-magnesium alloys (7000 series) using glasses which essentially comprise phosphoric anhydride, alumine and sodium oxide. However, it has not been possible to exceed drawing speeds in the order of 18 to 24 meters per minute, whereas the common practice is to draw steel by the Ugine-Sejournet method at speeds in the order of 300 meters per minute.

Applicants have discovered that the hot-drawing speed of light metals and alloys, particularly aluminium, magnesium and alloys based on aluminium and magnesium, can be increased very appreciably if the die is lubricated with a vitreous substance with a viscosity of from $10^3$ to $10^4$ poises, for a drawing temperature of from 400° to 650° C. They have found that drawing speeds of over 100 meters per minute can be achieved in this way, and that it is possible to obtain and even exceed 240 meters per minute and up to 300 meters per minute.

A formulation for a vitreous substance which is particularly well adapted to the application of this process comprises a mixture of alkaline phosphate and alkaline tetraborate, in a proportion such that the total composition of the mixture comes within the following limits:

—$P_2O_5$ : 25.6 to 68.3% by weight
—$B_2O_3$ : 1.7 to 53% by weight
—$K_2O$ : up to 30% by weight
—$Na_2O$ : up to 40% weight The presence of $K_2O$ is not however indispensable, and ternary compositions such as:

—$P_2O_5$ : 25.6 to 68.3% by weight
—$B_2O_3$ : 1.7 to 53% by weight
—$Na_2O$ : up to 40% by weight have been found to give results which are comparable and sometimes, in certain cases, better than those obtained with quaternary compositions containing $K_2O$.

The vitreous substances may be obtained equally well from sodium and/or potassium phosphates and borates as from the oxides $P_2O_5$, $B_3O_3$, $Na_2O$ and/or $K_2O$, in known manner.

It may be thought that, at a drawing temperature between 400° and 650° C, a superficial chemical reaction would take place between the vitreous substances defined above and the metal billet and between the hydraulic ram (container) and the die, and that this reaction would lead to the formation of layers with a low coefficient of friction, between which the vitreous substance would additionally act as a lubricant. The scope of the invention is in no way restricted to this hypothesis.

The method has been found to be particularly suitable for hot-drawing alloys which are regarded as being difficult to draw, such as those of series 2000, 5000 and 7000 (according to the definitions of the U.S. Aluminium Association) and some special alloys such as AU4Pb (as described in French Standard NF A 02001) which is a "screw cutting"alloy containing in particular 4.2% of copper and about 1.2% of lead, plus magnesium and manganese. These alloys normally have to be drawn at low speed, or surface cracks will be found to appear.

Alloys drawn by the method of the invention do not show any surface cracks or any central cavity due to the difference in drawing speed at the core and the periphery; nor do they have a peripheral zone with large grains, resulting from hot recrystallisation on passage of the die, as happens in prior art processes as soon as one attempts to increase the drawing speed.

The vitreous substances according to the invention have no harmful effects on workers or on the environment. They are not hygroscopic, a feature which facilitates storage and handling. They are also soluble in pure or slightly acidulated water, a feature which enables them to be removed from the surface of the products drawn simply by washing.

EXAMPLE 1

A vitreous substance is prepared as a lubricant for drawing, containing 270g of dihydrated monosodium phosphate and 30g of tetrahydrated potassium tetraborate.

The two materials are intimately mixed and heated gradually. When the vitreous substance has cooled it is ground finely enough to make it all pass through a screen with a mesh of 63 micrometers.

200g of the ground substance is then compressed into the form of a disc 84 mm in diameter and 15 mm thick. This is inserted, in contact with the die, in the hydraulic ram of a high speed drawing press which has previously been heated to about 350° C. A billet of AU4Pb alloy as defined above, 83 mm in diameter and 100 mm long, pre-heated to about 450° C and coated with the same vitreous substance over its whole peripheral surface, is then introduced and the drawing process is carried out immediately.

In prior art a billet of AU4Pb could be drawn at a maximum speed of 12 meters per minute. In this case the speed at which the rammer of the press advances is adjusted to make the shape emerge, with a diameter of 12 mm, at a speed of 282 meters per minute.

The bar obtained is free from any external or internal defects and has mechanical properties equivalent to those of bars made of AU4Pb which have been drawn at 450° C at 12 meters per minute and lubricated with graphite.

In this test the drawing ratio is 50.

EXAMPLE 2

Under conditions exactly the same as in example 1, another billet of AU4Pb is drawn with a drawing ratio of 25, the shape then emerging with a diameter of 17 mm.

The same drawing speed of 282 meters per minute is used, and the drawn bar is again perfectly sound and without any defects.

We claim:

1. A method of high-speed hot drawing light metals and alloys, particularly aluminum, magnesium and alloys based on aluminum or magnesium, comprising the steps of drawing the metal through a draw die and lubricating the die by interposing between the metal and the die a vitreous substance having a viscosity within the range of $10^3$–$10^4$ poises at a temperature within the range of 400°–650° C, in which the vitreous substance consists essentially of 25.6 to 68.3% by weight $P_2O_5$, 1.7 to 53% by weight $B_2O_3$ and up to 38.9% by weight $Na_2O$.

2. The method of claim 1, characterised in that the vitreous substance is water soluble and does not regain any moisture during storage.

3. A method of high-speed hot drawing light metals and alloys, particularly aluminum, magnesium and alloys based on aluminum or magnesium, comprising the steps of drawing the metal through a draw die and lubricating the die by interposing between the metal and the die a vitreous substance having a viscosity within the range of $10^3$–$10^4$ poises at a temperature within the range of 400°–650° C, in which the vitreous substance consists essentially of 25.6 to 68.3% by weight $P_2O_5$, 1.7 to 53% by weight $B_2O_3$, up to 38.9% by weight $Na_2O$ and up to 30% by weight $K_2O$.

* * * * *

UNITED STATES PATENT AND TRADEMARK OFFICE

CERTIFICATE OF CORRECTION

PATENT NO. : 4,068,513

DATED : January 17, 1978

INVENTOR(S) : Pierre Guerit and Gilbert Pollet

It is certified that error appears in the above-identified patent and that said Letters Patent are hereby corrected as shown below:

Column 2, line 1, "$B_3O_3$" should be --$B_2O_3$--

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*